US006502257B1

(12) United States Patent
Glenn

(10) Patent No.: US 6,502,257 B1
(45) Date of Patent: Jan. 7, 2003

(54) BEACH BLANKET

(76) Inventor: Rosemary Glenn, P.O. Box 770964, Eagle River, AK (US) 99577

( * ) Notice: Subject to any disclaimer, the term of this patent is extended or adjusted under 35 U.S.C. 154(b) by 0 days.

(21) Appl. No.: 10/086,612

(22) Filed: Mar. 1, 2002

(51) Int. Cl.[7] ..... A47G 9/06
(52) U.S. Cl. ..... 5/418; 135/16; 248/519
(58) Field of Search ..... 5/417–420; 135/16; 248/519

(56) References Cited

U.S. PATENT DOCUMENTS 2,533,322 A * 12/1950 Kober ..... 135/16
4,599,754 A 7/1986 Mairs et al.
4,789,247 A 12/1988 Schnoor
5,059,463 A * 10/1991 Peters ..... 5/418
5,347,667 A 9/1994 Schwarz et al.
D360,793 S 8/1995 Nwani
5,819,343 A 10/1998 Zampirri et al.
5,899,571 A 5/1999 Chalk
6,061,850 A * 5/2000 Roper, III ..... 5/418

* cited by examiner

*Primary Examiner*—Alexander Grosz

(57) ABSTRACT

A beach blanket for receiving an umbrella so that the umbrella is positioned over the blanket includes a panel having an upper side, a lower side and a peripheral edge. The panel comprises a flexible material. The panel has at least one opening extending therethrough for receiving a bottom end of an umbrella handle. A cover has a first portion and a second portion. The first portion is attached to the panel and extending over the opening. The first portion has a hole extending therethrough and is generally aligned with the opening in the panel. The second portion is removably positionable in a closed position extending over the hole or an open position.

10 Claims, 2 Drawing Sheets

BEACH BLANKET

BACKGROUND OF THE INVENTION

1. Field of the Invention

The present invention relates to beach blanket devices and more particularly pertains to a new beach blanket for receiving an umbrella so that the umbrella is positioned over the blanket.

2. Description of the Prior Art

The use of beach blanket devices is known in the prior art. U.S. Des. Pat. No. 360,793 describes a device having a combination of blanket and sunshade. Another type of beach blanket devices is U.S. Pat. No. 4,599,754 having a blanket with a plurality of openings extending therethrough for receiving posts supporting windscreens.

While these devices fulfill their respective, particular objectives and requirements, the need remains for a device that receives an umbrella and includes covers for umbrella receiving openings so that sand does not move upwardly through the openings when they are not in use.

SUMMARY OF THE INVENTION

The present invention meets the needs presented above by providing a panel having an opening extending therethrough and a cover for selectively opening or closing the opening.

Still yet another object of the present invention is to provide a new beach blanket that includes loop members for receiving stakes.

To this end, the present invention generally comprises a panel having an upper side, a lower side and a peripheral edge. The panel comprises a flexible material. The panel has at least one opening extending therethrough for receiving a bottom end of an umbrella handle. A cover has a first portion and a second portion. The first portion is attached to the panel and extending over the opening. The first portion has a hole extending therethrough and is generally aligned with the opening in the panel. The second portion is removably positionable in a closed position extending over the hole or an open position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
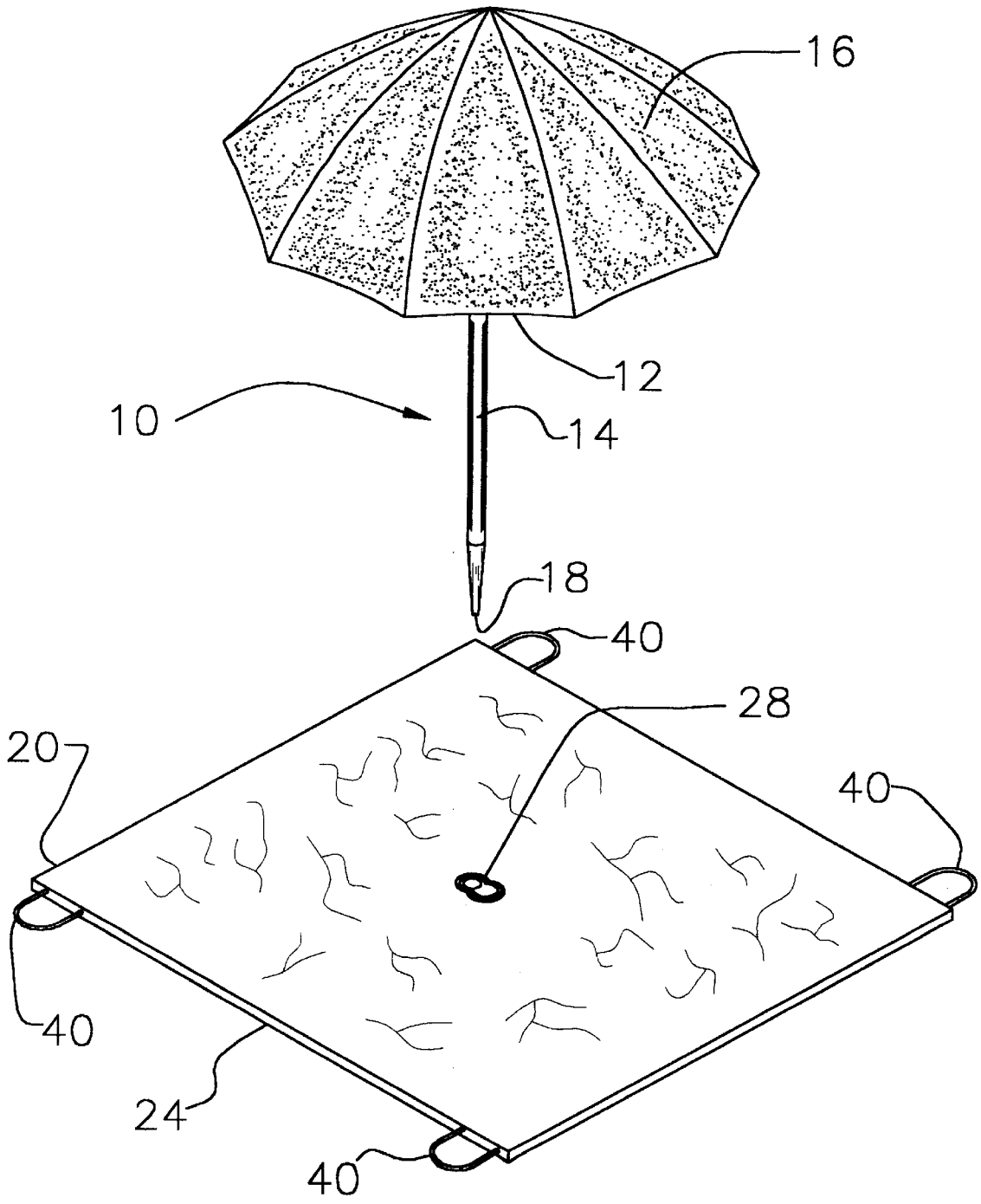
FIG. 1 is a schematic perspective view of a new beach blanket according to the present invention.
Figure 2:
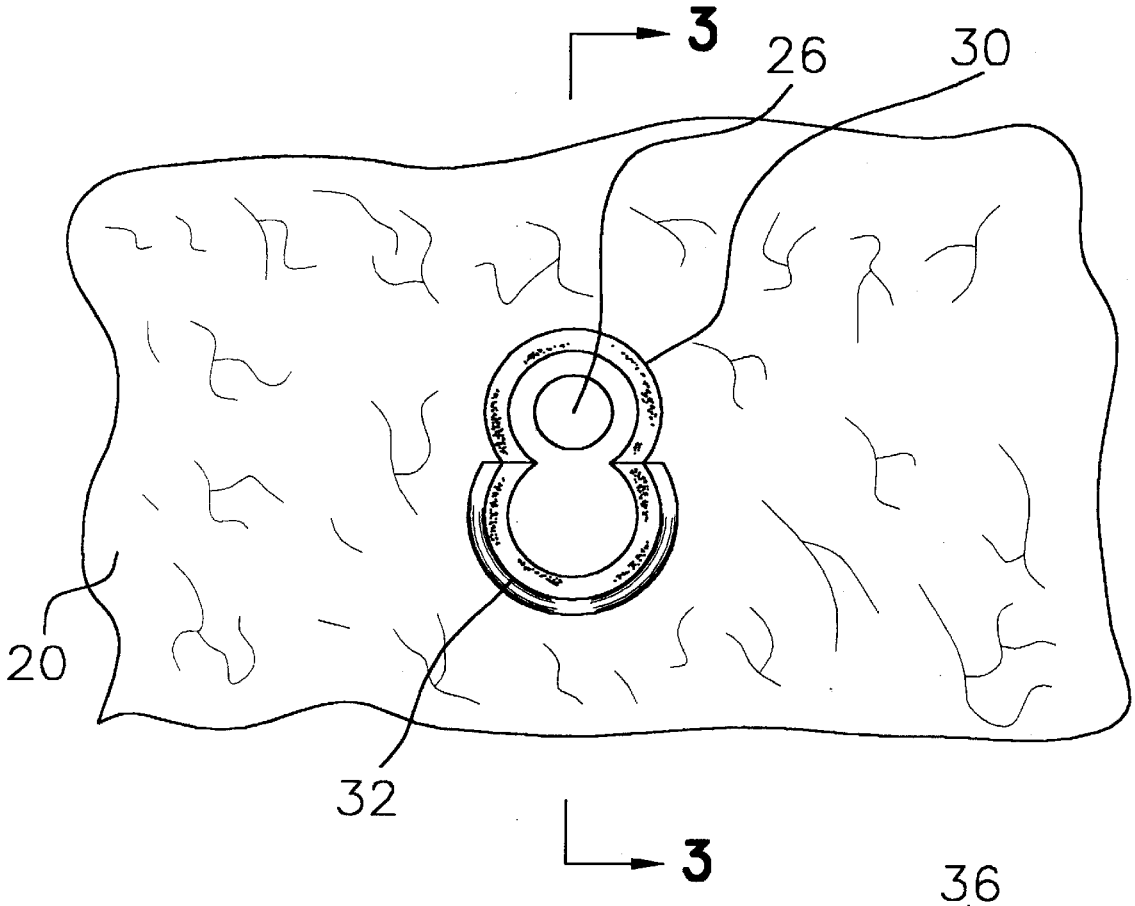
FIG. 2 is a schematic top view of the present invention.
Figure 3:
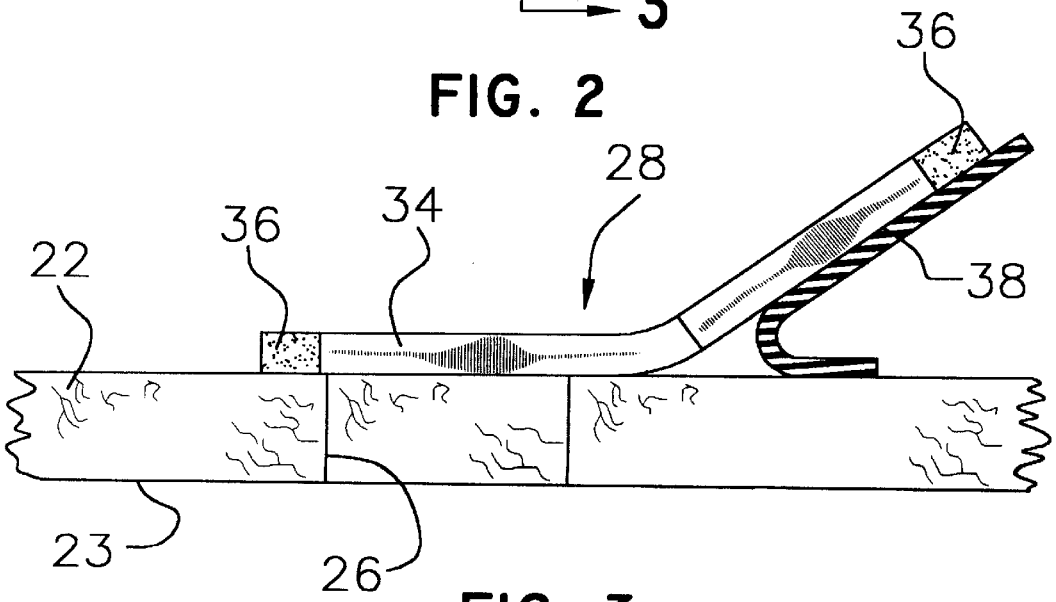
FIG. 3 is a schematic cross-sectional view taken along line 3—3 of FIG. 2 of the present invention.

With reference now to the drawings, and in particular to FIGS. 1 through 3 thereof, a new beach blanket embodying the principles and concepts of the present invention and generally designated by the reference numeral 10 will be described.

As best illustrated in FIGS. 1 through 3, the beach blanket 10 generally comprises an umbrella 12 including an elongate handle portion 14 and a canopy portion 16. The canopy portion 16 is attached to the handle portion 14. The handle portion 14 has a bottom end 18 which is tapered.

A panel 20 has an upper side 22, a lower side 23 and a peripheral edge 24. The panel 20 comprises a flexible material. The panel 20 has at least one opening 26 extending therethrough for receiving the bottom end 18 of the handle portion 14. The panel 20 may have a plurality of openings 26, not shown, extending therethrough. The panel 20 is preferably comprised of a cotton material.

A cover 28 has a first portion 30 and a second portion 32. The first portion 30 is attached to the upper side 22 of the panel 20 and extends over the opening 26. The first portion 30 has a hole 34 extending therethrough that is generally aligned with the opening 26 in the panel 20. The second portion 32 is removably positionable in a closed position extending over the opening 26 and an open position. In the event there is a plurality of openings 26, a plurality of covers 28 may be employed so that only the opening 26 which is going to be used is uncovered.

A fastening means 36 is attached to the cover 28 for selectively fastening the second portion to the first portion in the closed position. The fastening means 36 preferably comprises a hook and loop fastener through snaps or zippers may also be used. A biasing means, such as a resiliently flexible plate 38 may be attached to the second portion for biasing the second portion in the closed position.

A plurality of loop members 40 is attached to the peripheral edge 24 of the panel 20. The loop members 40 are spaced from each other. Stakes may be extended through the loop members 40 for holding the panel 20 to a ground surface.

In use, the opening 26 is uncovered so that the umbrella 12 may be extended through the opening 26 and into a ground surface. This allows positioning of the canopy 16 directly over the panel 20. The cover 28 may be used to close the opening 26 so that sand is not moved upward through the opening 26 and onto the upper surface 22 of the panel 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beach blanket device for selectively receiving an umbrella having an elongate handle portion and a canopy portion, the canopy portion being attached to the handle portion, the handle having a bottom end, said bottom end being tapered, said device comprising:

a panel having an upper side, a lower side and a peripheral edge, said panel comprising a flexible material, said panel having at least one opening extending therethrough for receiving the bottom end of the handle portion; and a cover having a first portion and a second portion, said first portion being attached to said panel and extending over said opening, said first portion having a hole extending therethrough and being generally aligned with said opening in said panel, said second portion being removably positionable in a closed position extending over said opening and an open position.

2. The beach blanket device as in claim 1, further including a fastening means being attached to said cover for selectively fastening said second portion to said first portion in said closed position.

3. The beach blanket device as in claim 2, wherein said fastening means comprises a hook and loop fastener.

4. The beach blanket device as in claim 3, further including a plurality of loop members being attached to said peripheral edge of said panel, said loop members being spaced from each other.

5. The beach blanket device as in claim 1, further including a plurality of loop members being attached to said peripheral edge of said panel, said loop members being spaced from each other.

6. A beach blanket and umbrella combination comprising:

an umbrella including an elongate handle portion and a canopy portion, said canopy portion being attached to said handle portion, said handle having a bottom end, said bottom end being tapered;

a panel having an upper side, a lower side and a peripheral edge, said panel comprising a flexible material, said panel having at least one opening extending therethrough for receiving the bottom end of the handle portion; and a cover having a first portion and a second portion, said first portion being attached to said panel and extending over said opening, said first portion having a hole extending therethrough and being generally aligned with said opening in said panel, said second portion being removably positionable in a closed position extending over said opening and an open position.

7. The beach blanket device as in claim 6, further including a fastening means being attached to said cover for selectively fastening said second portion to said first portion in said closed position.

8. The beach blanket device as in claim 7, wherein said fastening means comprises a hook and loop fastener.

9. The beach blanket device as in claim 6, further including a plurality of loop members being attached to said peripheral edge of said panel, said loop members being spaced from each other.

10. A beach blanket and umbrella combination comprising:

an umbrella including an elongate handle portion and a canopy portion, said canopy portion being attached to said handle portion, said handle having a bottom end, said bottom end being tapered;

a panel having an upper side, a lower side and a peripheral edge, said panel comprising a flexible material, said panel having at least one opening extending therethrough for receiving the bottom end of the handle portion;

a cover having a first portion and a second portion, said first portion being attached to said panel and extending over said opening, said first portion having a hole extending therethrough and being generally aligned with said opening in said panel, said second portion being removably positionable in a closed position extending over said opening and an open position;

a fastening means being attached to said cover for selectively fastening said second portion to said first portion in said closed position, said fastening means comprising a hook and loop fastener; and a plurality of loop members being attached to said peripheral edge of said panel, said loop members being spaced from each other.

* * * * *